US006679304B1

(12) United States Patent
Vacca

(10) Patent No.: US 6,679,304 B1
(45) Date of Patent: Jan. 20, 2004

(54) FLEXIBLE REFILLING CONTAINER

(76) Inventor: Frank Vacca, 806 Locust Dr., Sleepy Hollow, IL (US) 60118

( * ) Notice: Subject to any disclaimer, the term of this patent is extended or adjusted under 35 U.S.C. 154(b) by 35 days.

(21) Appl. No.: 10/162,298

(22) Filed: Jun. 4, 2002

(51) Int. Cl.[7] ..... B65B 3/04

(52) U.S. Cl. ..... 141/313; 141/2; 141/18; 141/364; 141/384

(58) Field of Search ..... 141/2, 18, 313, 141/363, 364, 365, 366, 383, 384, 386; 222/92, 106

(56) References Cited

U.S. PATENT DOCUMENTS

| | | | | |
|---|---|---|---|---|
| 2,448,993 | A | | 9/1948 | Lamar |
| 3,206,075 | A | | 9/1965 | Scholle |
| 4,290,466 | A | | 9/1981 | Villa et al. |
| 4,487,336 | A | | 12/1984 | Sneider |
| 4,573,506 | A | * | 3/1986 | Paoletti ..... 141/98 |
| 4,576,313 | A | | 3/1986 | Smith et al. |
| 4,625,780 | A | | 12/1986 | Burnham |
| 4,776,488 | A | | 10/1988 | Gurzan |
| 5,010,928 | A | | 4/1991 | Ballas |
| 5,102,010 | A | | 4/1992 | Osgar et al. |
| 5,131,566 | A | | 7/1992 | Bavegems |
| 5,220,949 | A | | 6/1993 | Rufenacht |
| 5,282,495 | A | | 2/1994 | Chamberlain |
| 5,289,949 | A | | 3/1994 | Gentile |
| 5,328,284 | A | | 7/1994 | Moeck et al. |
| 5,335,827 | A | | 8/1994 | Gentile |
| 5,337,921 | A | | 8/1994 | Wilson et al. |
| 5,409,125 | A | | 4/1995 | Kimber et al. |
| 5,490,545 | A | | 2/1996 | Sokoloff et al. |
| 5,607,003 | A | | 3/1997 | Gray |
| 5,609,266 | A | | 3/1997 | Nakazato et al. |
| 5,632,315 | A | | 5/1997 | Rose |
| 5,819,986 | A | | 10/1998 | Last et al. |
| 5,823,383 | A | | 10/1998 | Hins |
| 6,000,848 | A | | 12/1999 | Massioui |
| 6,053,360 | A | * | 4/2000 | Rutter ..... 222/1 |
| 6,164,822 | A | | 12/2000 | Beer |
| 6,209,995 | B1 | | 4/2001 | Grune et al. |
| 6,273,307 | B1 | | 8/2001 | Gross et al. |

* cited by examiner

*Primary Examiner*—Gregory Huson
*Assistant Examiner*—Peter de Vore
(74) *Attorney, Agent, or Firm*—Mathew R. P. Perrone, Jr.

(57) ABSTRACT

A flexible container having a flexible pouch with a valve assembly mounted thereon is secured to a dispensing container in a sealed relationship with the valve assembly. Then the flexible pouch is squeezed in order to move a fluid from the flexible pouch through the valve assembly into the dispensing container. The dispensing container is thus refilled and made ready for use.

11 Claims, 5 Drawing Sheets

FLEXIBLE REFILLING CONTAINER

This invention relates to a refilling container, and more particularly to a flexible refilling container attachable to a dispensing container, the dispensing container being both container being refilled.

BACKGROUND OF THE INVENTION

Any recycling process provides many advantages. Valuable resources are conserved, while permitting reuse of materials. For example, many standard containers, used as dispensing container for use material contained therein, are very durable and capable of being refilled. With such refilling, more efficient use of resources is permitted.

However, there are many difficulties within an efficient refilling process. During the refilling, it is desired to avoid spilling as the one material is being passed from the refilling container to the dispensing container. By refilling container is meant the supply container. By dispensing container is meant the use container or the container, from which dispensing of a fluid for a direct use or a substantially immediate use is made.

The attachment of the refilling container to the dispensing container must be sufficiently secure to avoid leakage or other spilling. Also, the refilling container must be easily released from the dispensing container after such refilling is complete.

Both the releasing and the attaching steps provide a substantial opportunity for spillage. Such a spillage has an adverse effect on the recycling advantages of such a procedure. Thus, spillage must be minimized.

The release of material from the refilling container into the dispensing container prior to being inserted therein must be carefully controlled. To that end, the opening of the refilling container in order to permit the material to pass therethrough must be accomplished at the right time. The opening must also be carefully controlled.

Additional problems may occur with a fluid transfer. Such a fluid transfer is complicated in proportion to increase in viscosity of the fluid being transferred. If a fluid is viscous, it may not flow easily from a refilling container into a dispensing container.

With the opening, the attachment to the dispensing container must be accomplished swiftly in order to minimize passage of material through the opening. Such coordination is difficult, if not impossible, with the refilling containers of the prior art. To that end, great advantages can be obtained, provided the opening can be controlled while permitting provision of a flexible refilling container capable of being efficiently attached to the dispensing container.

A further objective of this invention is the provision of an easily openable refilling container.

Yet a further objective of this invention is the provision of a flexible refilling container capable of being released easily from a dispensing container.

A still further objective of this invention is the provision of a flexible refilling container capable of minimizing spillage during the refilling process.

Also, an objective of this invention is the provision of a flexible refilling container capable of transferring a viscous fluid.

Another objective of this invention is the provision of a method for easily refilling a dispensing container.

Yet another objective of this invention is the provision of a method, whereby a viscous fluid may be released easily from a dispensing container.

Still, another objective of this invention is the provision of a method for applying pressure to a refilling container in order to promote transfer of fluid to a dispensing container.

These and other objectives of the invention (which other objectives become clear by consideration of the specification, claims and drawings as a whole) are met by providing a flexible container a flexible pouch having a valve assembly with mounted thereon. The valve assembly may be secured to a dispensing container in a sealed relationship with the valve assembly. Then the flexible pouch is squeezed in order to move a fluid from the flexible pouch through the valve assembly into the dispensing container. The dispensing container is thus refilled and made ready for use.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

In order to reduce the time it takes to add a fluid to a dispensing container, a flexible container having a flexible pouch with a valve assembly is provided for refilling a dispensing container. The fluid in the flexible pouch can pass from the flexible pouch through the valve assembly into the dispensing container.

The flexible pouch of the dispensing container provides an improved manner of transferring a viscous liquid or fluid to a dispensing container. With the valve assembly open, the flexible pouch may be squeezed, there by applying pressure to the viscous fluid invoicing the same through the opening valve assembly into the dispensing container, which is attached to the valve assembly.

With a flexible refilling container, transportation is greatly simplified, whether the container is or empty. With the flexible refilling container being shipped as full, such flexibility permits more compact shipping in that more containers can be stored or shipped in the same shipping space.

Also, when empty, this flexible refilling container is even more compact and can be shipped in less space. Thus, the empty containers are more easily transported for either recycling or reuse. Clearly such containers can also be refilled if desired.

In a preferred form, the valve assembly provides for a secure attachment to a dispensing container. The squeezing of flexible pouch permits fluid to be forced from flexible container out of flexible pouch through valve assembly into a dispensing container. By the same token, the valve assembly further permits securing so that the flexible refilling container may itself be a dispensing container and have a plurality of uses as a refilling container.

Also in a preferred form, the valve assembly attached to the flexible refilling container has a vent passage. This debt passage permits entry of air into the transfer area of the fluid passing between the flexible container and the dispensing container.

A further preferred valve assembly is one-piece. The one-piece valve may be formed by injection molding. Such formation minimizes the assembly requirements of the valve assembly. It is also possible for both an accumulated valve, or a washer valve to be injection molded, but supported by a washer.

Figure 1:
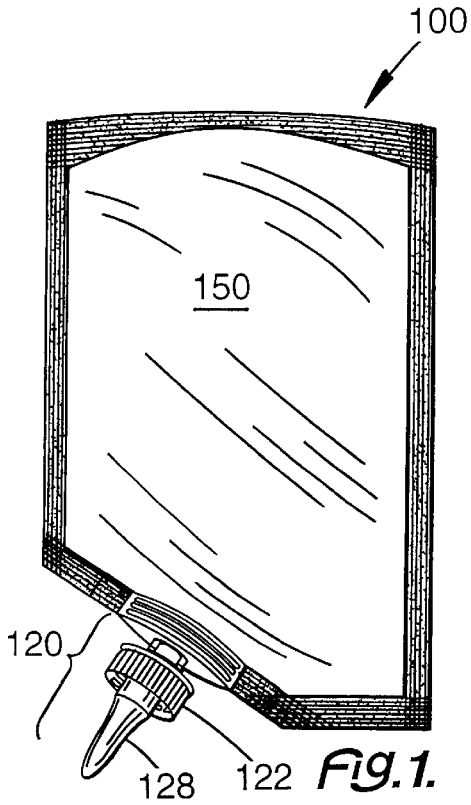
FIG. 1 depicts a perspective view of the flexible refilling container 100 of this invention.

Referring now to FIG. 1, flexible refilling container 100 has accumulated valve assembly 120 mounted on flexible pouch 150. Accumulated valve assembly 120 combines with flexible pouch 150 in order to permit a release of a desired amount of fluid from the flexible pouch 150.

Figure 2:
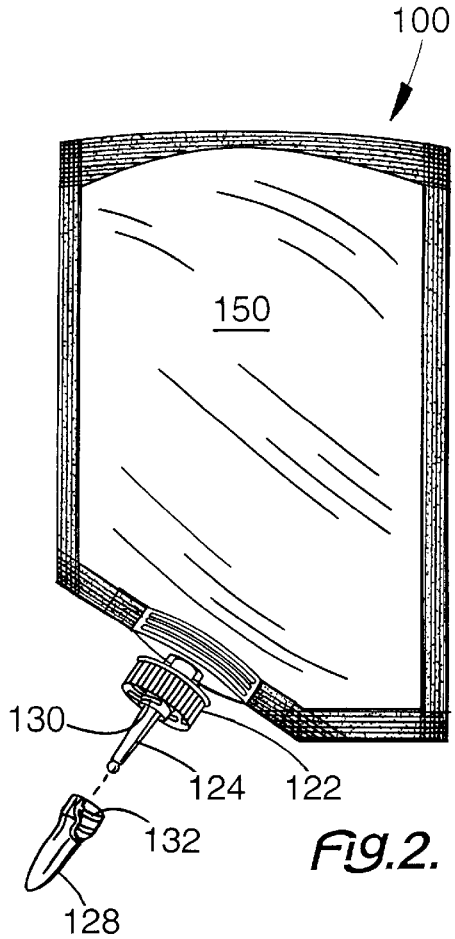
FIG. 2 depicts a partially exploded, perspective view of the flexible refilling container 100 of this invention.

Adding FIG. 2 to the consideration, valve assembly 120 has a connector cap 122 with a spout 124 extending therefrom. Spout 124 communicates with flexible pouch 150 through connector cap 122. Closing cap 128 fits over spout 124 onto male spout threads 130. Closing cap 128 includes female cap threads 132. Clearly female cap threads 132 can be attached to or released from male spout threads 130 as desired.

Figure 3:
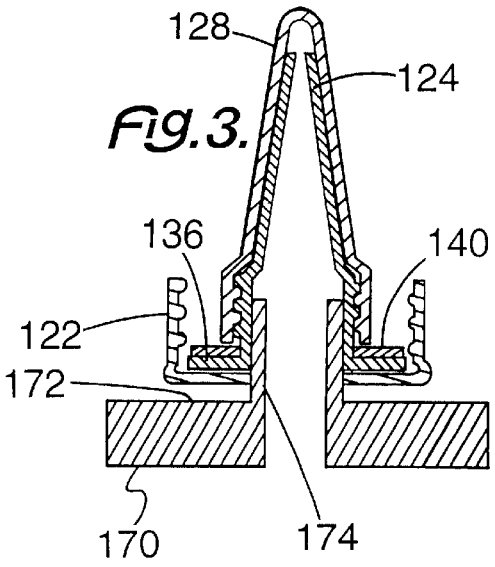
FIG. 3 depicts a side, cross-sectioned view of the valve assembly 120 for flexible refilling container 100 of this invention.

With FIG. 3 additionally considered, spout 124 is closed with cap 128. Connector cap 122 is held in place between spout base 136 and neck base support 172, thereby allowing connector cap 122 to turn freely. Adjacent to spout base 136 is washer gasket 140. Neck base nozzle 174 is secured to spout 124, by glue, sonic weld or another suitable bonding system.

Figure 5:
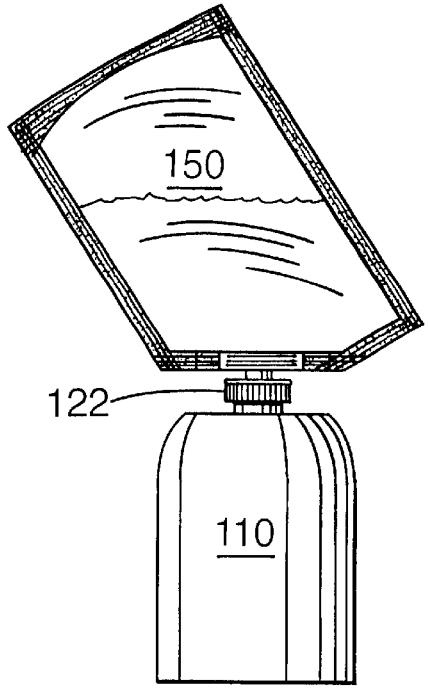
FIG. 5 depicts a side view of the flexible refilling container 100 of this invention attached to dispensing container 110.

Washer gasket 140 seals the connection between refilling pouch 100 and dispensing container 110 of FIG. 5. From male spout threads 130 extends spout 124. Spout 124 communicates with flexible pouch 150 and permits refilling of dispensing container 110.

Figure 4:
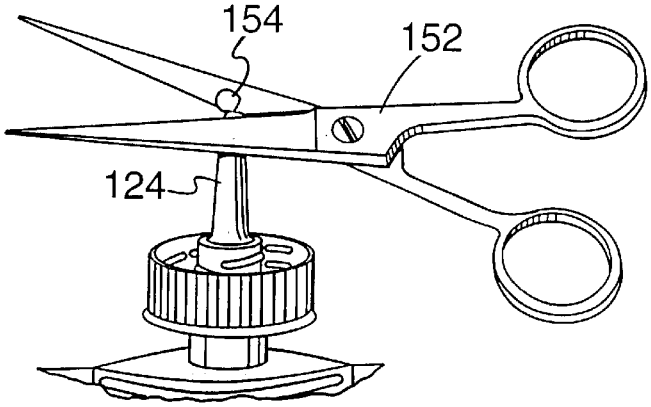
FIG. 4 depicts a perspective view of the valve assembly 120 for flexible refilling container 100 of this invention.

From FIG. 4, a fixed seal 154 can close spout 124. With cutting device 152, fixed seal 154 can be separated from spout 124 and permit flow from flexible refilling container 100 to dispensing container 110 of FIG. 5.

Figure 6:
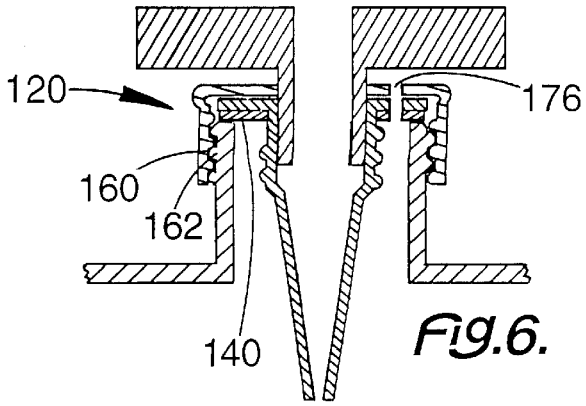
FIG. 6 depicts a side, cross-sectioned view of the valve assembly 120 for flexible refilling container 100 of this invention attached to dispensing container 114.

With FIG. 5 and FIG. 6, the connection of flexible refilling pouch 100 to dispensing container 110 can be seen. Such a tight seal is due to the gasket 140 with the structure of accumulated valve assembly 120. Female valve threads 160 are secured to male dispensing container threads 162, thereby providing a tight seal as required.

Figure 7:
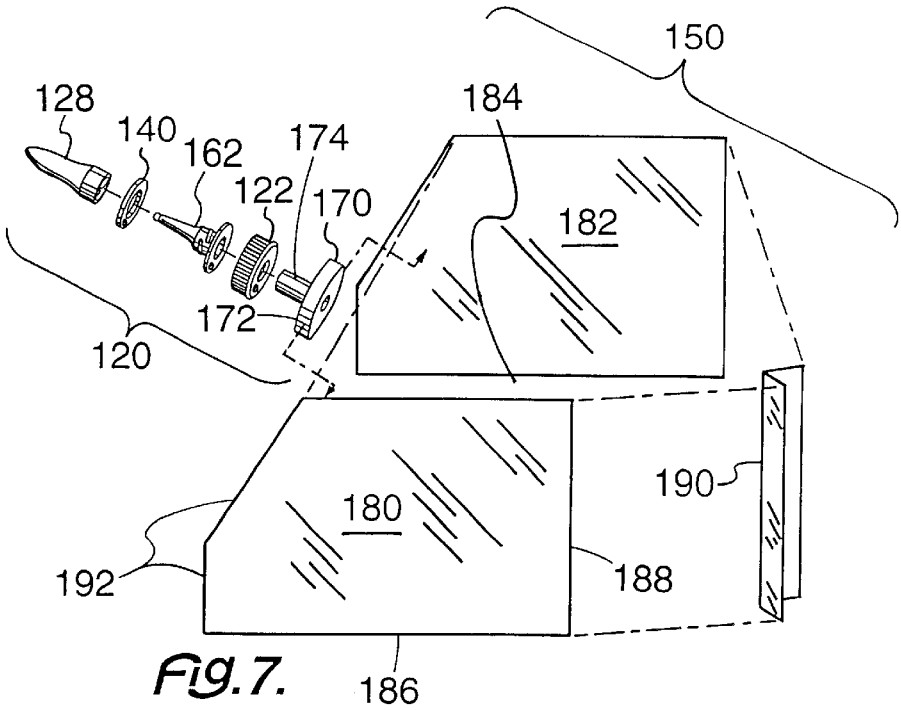
FIG. 7 depicts an exploded view of the accumulated valve assembly 120 attachable to flexible pouch 150 in order to form flexible refilling container 100 of this invention.

In FIG. 6 and FIG. 7, the connection of flexible refilling pouch 100 is assisted by base vent 176. In this manner, the vacuum created by the fluid transfer is minimized.

With FIG. 7 showing an exploded view of valve assembly 120, the structure becomes even more clear. Neck base 170 is secured to flexible pouch 150, and provides support for the balance of accumulated valve assembly 120 to the secured thereto. Connector cap 140 fits over neck base 170 and onto neck base support 172 and around that neck base nozzle 174. Over neck base nozzle 174 fits dispensing nozzle 162. Then, the gasket 140 and cap 160 may be attached in the previously described fashion.

Flexible pouch 150 is shown as opened with a first flap 180 and second flap 182. First flap 180 can be folded over second flap 182 at fold 184. Opposite fold 184 is first seal 186. Adjacent to first seal 186 is base seal 188 to close bottom 190 of flexible pouch 150.

Top seal 192 receives accumulated valve assembly 120 and seals flexible pouch 150 therearound. More specifically, neck base 170 both receives top seal 192 and locks the accumulated valve assembly 120 in flexible pouch 150. Thus, flexible refilling container 100 can be completely emptied and reused.

Figure 8:
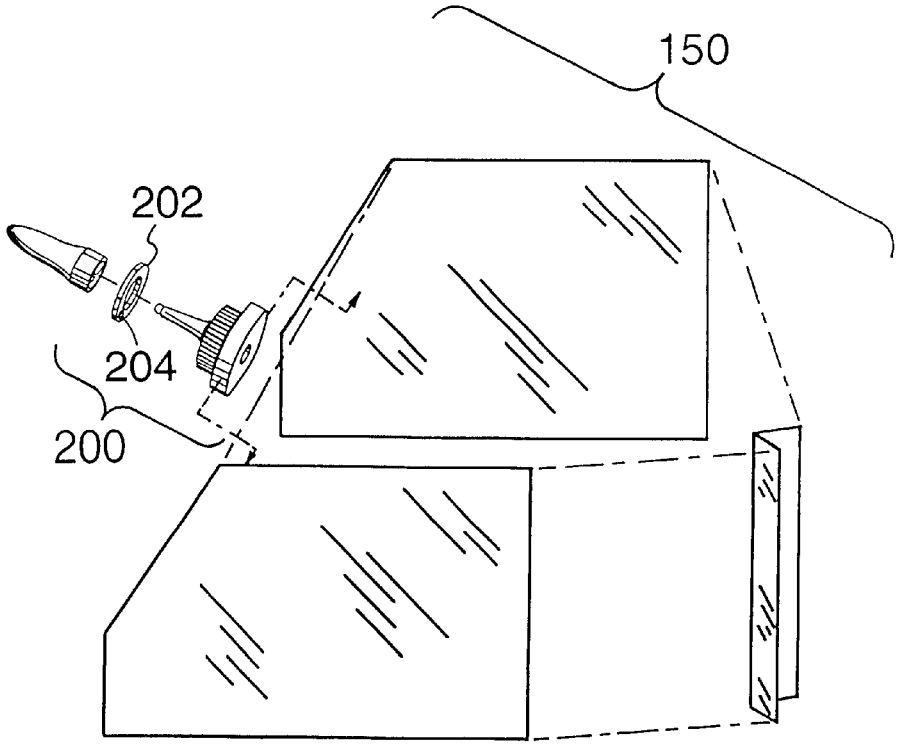
FIG. 8 depicts a perspective view of the washer valve assembly 200 attachable to flexible pouch 150 in order to form flexible refilling container 100 of this invention.
Figure 9:
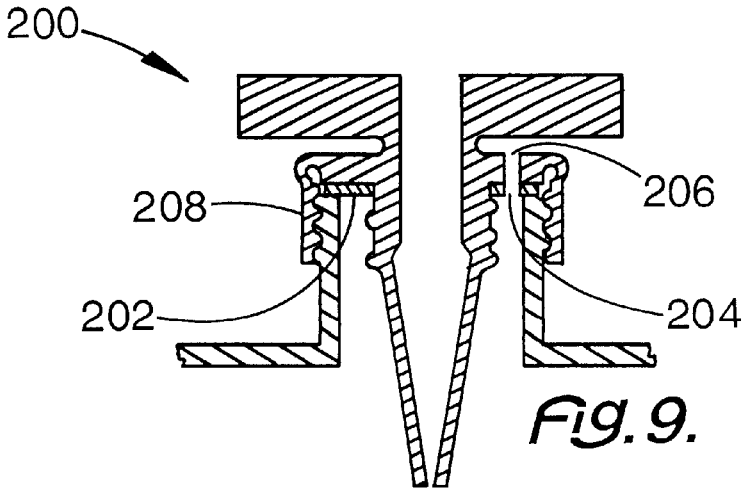
FIG. 9 depicts a side view of the washer valve assembly 200 attachable to flexible pouch 150 based on FIG. 8 in cross section.

Turning now to FIG. 8 and FIG. 9, washer valve assembly 200 has a structure similar to accumulated valve assembly 120. However, instead of the variety of pieces for accumulated valve assembly 120 attachable to flexible pouch 150 in order to form flexible refilling container 100, washer valve assembly 200 is injected molded or otherwise shaped to form all elements of accumulated valve assembly 120. If desired, washer valve assembly 200 has inserted therein a vented gasket 202. Vented gasket 202 has a vent aperture 204 which aligns with housing aperture 206 and threaded base 208. The threaded base 208 forms a top portion of threaded attachment 210, which secures washer valve assembly 200 to dispensing container 110.

Figure 10:
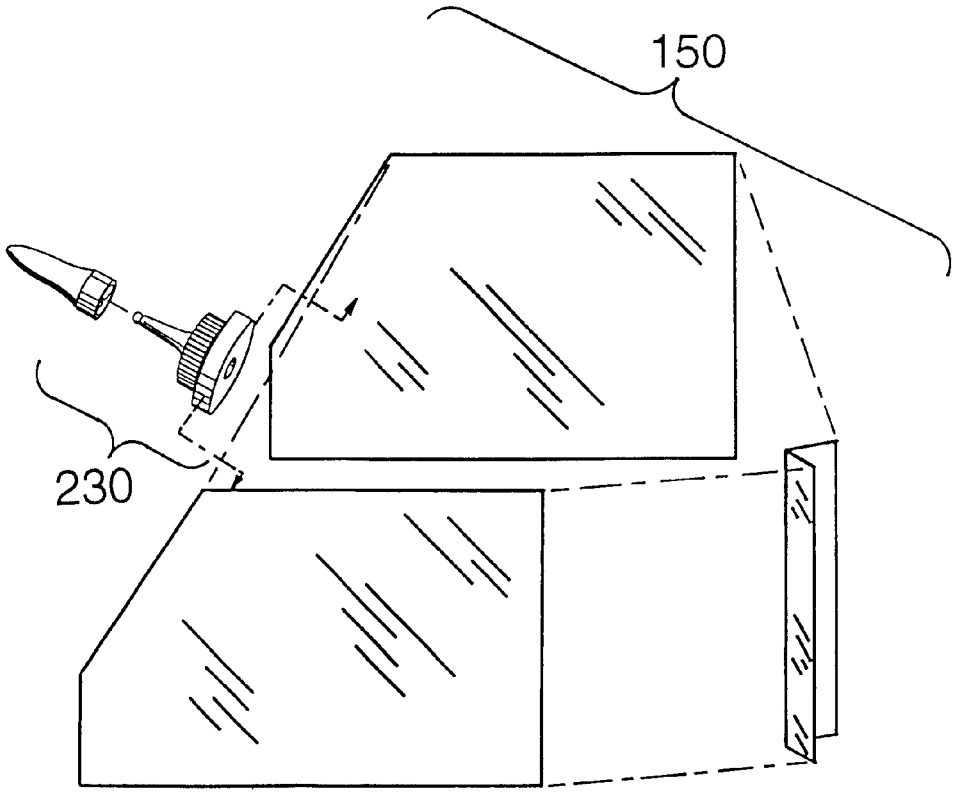
FIG. 10 depicts a perspective view of the unitary valve assembly 230 attachable to flexible pouch 150 in order to form flexible refilling container 100 of this invention.
Figure 11:
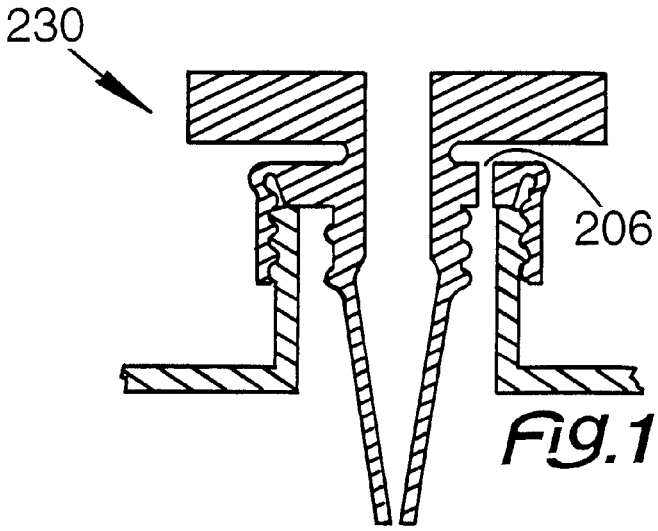
FIG. 11 depicts a side view of the unitary valve assembly 230 attachable to flexible pouch 150 based on FIG. 10 in cross section.

FIG. 10 and FIG. 11 combined to show the preferred unitary valve assembly 230 attachable to flexible pouch 150 in order to form flexible refilling container 100 of this invention. This unitary valve assembly 230 may simply be molded and requires no assembly or insertion of any washer. The structure of this unitary valve assembly 230 is similar to accumulated valve assembly 120. However, with the one step molding process, no assembly is required. The structure present in the accumulated valve assembly 120 is provided by the structure of the mold.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A method of refilling a dispensing container with a flexible refilling container comprising:

(a) providing a valve assembly secured to a flexible pouch in order to form the flexible refilling container;

(b) releasably securing the valve assembly to the dispensing container with a connector cap on the valve assembly;

(c) squeezing the flexible pouch in order to force a fluid in the flexible refilling container through the valve assembly into the dispensing container, thereby adding at least a portion of the fluid to the dispensing container, in order to provide a fluid level;

(d) recovering the dispensing container with the fluid level therein;

(e) the flexible pouch being adapted to hold, a fluid for the flexible refilling container;

(f) the valve assembly communicating with the flexible pouch to complete the flexible refilling container;

(g) a the valve assembly being releasably attachable to the dispensing container;

(h) the valve assembly being releasably sealable to the dispensing container in order to permit the fluid to pass therethrough from the flexible pouch to the dispensing container;

(i) the valve assembly having a connector cap with a spout extending therefrom;

(j) the connector cap being adapted to support the spout within the dispensing container;

(k) a sealing means for the connector cap being adapted to seal the dispensing container to the flexible refilling container;

(l) providing a first flap and a second flap for the flexible refilling container;

(m) folding the first flap folded over the second flap to form a first fold;

(n) providing a first seal opposite the first fold;

(o) providing a base seal adjacent to the first seal and the first fold in order to close a bottom of the flexible pouch; and (p) providing a top seal to receive the valve assembly and seal a top of the flexible pouch around the valve assembly.

2. A flexible refilling container attachable to a dispensing container, comprising:

(a) a flexible pouch being adapted to hold a liquid for the flexible refilling container;

(b) a valve assembly communicating with the flexible pouch to complete the flexible refilling container;

(c) the valve assembly being releasably attachable to the dispensing container;

(d) the valve assembly being releasably sealable to the dispensing container in order to permit the liquid to pass therethrough from the flexible pouch to the dispensing container as a pressure is applied to the flexible pouch**;

(e) the valve assembly having a connector cap with a spout extending therefrom;

(f) the connector cap being adapted to support the spout within the dispensing container;

(g) a sealing means for the connector can being adapted to releasably seal the dispensing container to the flexible refilling container;

(h) a closing cap fitting over the spout;

(i) the closing cap being releasably securable to the spout;

(j) the closing cap being releasably sealable to the spout in order to prevent a flow of the liquid therethrough;

(k) the spout having male spout threads at a spout base thereof;

(l) the closing cap having interior female cap threads at a cap base thereof;

(m) the male spout threads cooperating with the female cap threads to secure the closing cap to the spout; and (n) the valve assembly being a housing and a washer.

3. The flexible refilling container of claim 2 further comprising the valve assembly having a vent aperture in the connector cap adjacent to the spout.

4. The flexible refilling container of claim 3 further comprising the valve assembly being a assembled from a plurality of parts.

5. The flexible refilling container of claim 4 further comprising:

(a) a closing cap fitting over the spout;

(b) the closing cap being releasably securable to the spout; and (c) the closing cap being releasably sealable to the spout in order to prevent a flow of the liquid therethrough; therein.

6. The flexible refilling container of claim 5 further comprising:

(a) the spout having male spout threads at a spout base thereof;

(b) the closing cap having interior female cap threads at a cap base thereof; and (c) the male spout threads cooperating with the female cap threads to secure the closing cap to the spout.

7. The flexible refilling container of claim 3 further comprising the valve assembly being a one-piece valve.

8. The flexible refilling container of claim 7 further comprising:

(a) a closing cap fitting over the spout;

(b) the closing cap being releasably securable to the spout; and (c) the closing cap being releasably sealable to the spout in order to prevent a flow of the liquid therethrough; therein.

9. The flexible refilling container of claim 8 further comprising:

(a) the spout having male spout threads at a spout base thereof;

(b) the closing cap having interior female cap threads at a cap base thereof; and (c) the male spout threads cooperating with the female cap threads to secure the closing cap to the spout.

10. The flexible refilling container of claim 3 further comprising:

(a) a closing cap fitting over the spout;

(b) the closing cap being releasably securable to the spout; and (c) the closing cap being releasably sealable to the spout in order to prevent a flow of the liquid therethrough; therein.

11. The flexible refilling container of claim 10 further comprising:

(a) the spout having male spout threads at a spout base thereof;

(b) the closing cap having interior female cap threads at a cap base thereof; and (c) the male spout threads cooperating with the female cap threads to secure the closing cap to the spout.

* * * * *